US012203155B2

(12) United States Patent
Saito et al.

(10) Patent No.: US 12,203,155 B2
(45) Date of Patent: Jan. 21, 2025

(54) STEEL SHEET FOR CANS AND METHOD FOR MANUFACTURING THE SAME

(71) Applicant: JFE Steel Corporation, Tokyo (JP)

(72) Inventors: Hayato Saito, Tokyo (JP); Nobusuke Kariya, Tokyo (JP); Katsumi Kojima, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 840 days.

(21) Appl. No.: 17/294,531

(22) PCT Filed: Nov. 5, 2019

(86) PCT No.: PCT/JP2019/043178

§ 371 (c)(1),
(2) Date: May 17, 2021

(87) PCT Pub. No.: WO2020/105406

PCT Pub. Date: May 28, 2020

(65) Prior Publication Data

US 2022/0018003 A1 Jan. 20, 2022

(30) Foreign Application Priority Data

Nov. 21, 2018 (JP) ..... 2018-217823

(51) Int. Cl.

| | |
|---|---|
| ***C22C 38/12*** | (2006.01) |
| ***C21D 8/02*** | (2006.01) |
| ***C21D 9/00*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C22C 38/12* (2013.01); *C21D 8/0205* (2013.01); *C21D 8/0226* (2013.01); *C21D 8/0236* (2013.01); *C21D 9/0081* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01)

(58) Field of Classification Search

CPC ..... C22C 38/12; C22C 38/001; C22C 38/002; C22C 38/02; C22C 38/04; C22C 38/06; C22C 38/14; C21D 8/0205; C21D 8/0226; C21D 8/0236; C21D 9/0081; C21D 9/46; C21D 8/041; C21D 8/0426; C21D 8/0436; C21D 8/0463; C21D 8/0473; C21D 2211/005; C21D 2211/009; C21D 9/48

See application file for complete search history.

(56) References Cited

U.S. PATENT DOCUMENTS

| | | | | |
|---|---|---|---|---|
| 6,171,416 | B1 | 1/2001 | Aratani et al. | |
| 8,795,443 | B2 | 8/2014 | Nishihara et al. | |
| 2017/0067132 | A1* | 3/2017 | Takeda | C22C 38/008 |
| 2018/0044753 | A1* | 2/2018 | Honda | C22C 38/001 |
| 2020/0024681 | A1 | 1/2020 | Saito et al. | |

FOREIGN PATENT DOCUMENTS

| | | | |
|---|---|---|---|
| CN | 102666885 | | 9/2012 |
| CN | 106795609 | A | 5/2017 |
| CN | 107406947 | A | 11/2017 |
| EP | 3255168 | A1 | 12/2017 |
| EP | 3399065 | A1 | 11/2018 |
| JP | 0762487 | A | 3/1995 |
| JP | 08325670 | A | 12/1996 |
| JP | 2008274332 | A | 11/2008 |
| KR | 20160052865 | A | 5/2016 |
| TW | 201732054 | A | 9/2017 |
| TW | 201837199 | A | 10/2018 |

OTHER PUBLICATIONS

International Search Report and Written Opinion for International Application No. PCT/JP2019/043178, dated Feb. 10, 2020, 5 pages.
Chinese Office Action with Search Report for Chinese Application No. 201980076638.4, dated Jun. 6, 2022, 11 pages.
Handbook of Modern Welding Production, May 31, 2007, 2 pages, Shanghai Welding Association Shanghai Science and Technology Press.
Extended European Search Report for European Application No. 19 886 227.8, dated Dec. 16, 2021, 6 pages.
Taiwanese Office Action with Search Report for Taiwanese Application No. 108141087, dated Jun. 4, 2020, 4 pages.
Dapeng, L., "Food Packaging", Harbin Map Press, Jun. 30, 2009, 3 pages, with Common knowledge evidence.
"Hot Strip Continuous Rolling Mill", Writing Committee China Machine Press, Oct. 31, 1976, 3 pages, with Common knowledge evidence.
Chinese Office Action th Report for Chinese Application No. 201980076838.4, dated Jan. 5, 2023, 10 pages.

* cited by examiner

*Primary Examiner* — Anthony M Liang
*Assistant Examiner* — Danny N Kang
(74) *Attorney, Agent, or Firm* — Buchanan Ingersoll & Rooney PC

(57) ABSTRACT

A steel sheet for cans has a chemical composition containing, in mass percent, C: 0.085% to 0.130%, Si: 0.04% or less, Mn: 0.10% to 0.60%, P: 0.02% or less, S: more than 0.010% to 0.020%, Al: 0.02% to 0.10%, N: 0.0005% to 0.0040%, Nb: 0.007% to 0.030%, and B: 0.0010% to 0.0050%, B/N that is the ratio of the content (mass percent) of B to the content (mass percent) of N being 0.80 or more, the remainder being Fe and inevitable impurities, and a ferrite microstructure containing 1.0% or more pearlite in terms of area fraction. The steel sheet for cans has a yield stress of 500 MPa or more, a tensile strength of 550 MPa or more, a uniform elongation of 10% or more, and a yield elongation of 5.0% or less.

8 Claims, No Drawings

STEEL SHEET FOR CANS AND METHOD FOR MANUFACTURING THE SAME

CROSS REFERENCE TO RELATED APPLICATIONS

This is the U.S. National Phase application of PCT/JP2019/043178, filed Nov. 5, 2019 which claims priority to Japanese Patent Application No. 2018-217823, filed Nov. 21, 2018, the disclosures of these applications being incorporated herein by reference in their entireties for all purposes.

FIELD OF THE INVENTION

The present invention relates to a steel sheet for cans and a method for manufacturing the same. Aspects of the present invention particularly relate to a steel sheet for cans suitably applied as a material for making can containers such as food cans, beverage cans, and the like and methods for manufacturing the same. In particular, aspects of the present invention relate to a steel sheet for cans excellent in strength and workability and a method for manufacturing the same

BACKGROUND OF THE INVENTION

In recent years, the reduction in the amount of steel sheets used for food cans and beverage cans has been required from the viewpoint of reducing environmental impact and reducing costs, and the reduction in thickness of steel sheets has been progressing irrespective of two-piece cans and three-piece cans. Furthermore, the reduction in thickness of not only can body portions but also can lid portions such as easy open ends and can bottom portions has been strongly required.

Since reducing the thickness of steel sheets deteriorates the strength of cans, high-strength steel sheets need to be used. A steel sheet called a double reduced (DR) material is conventionally used as a high-strength steel sheet for cans in some cases. The DR material is a steel sheet manufactured by performing cold rolling (secondary rolling) again after annealing. Although the DR material has high strength, the DR material has low elongation and poor workability. Therefore, the DR material has not necessarily been applicable to can body processing cans which requires high workability or easy open ends which requires riveting.

In order to cope with such a problem, in single reduced (SR) materials manufactured by performing only temper rolling after annealing, a steel sheet for cans having high strength and excellent workability is necessary. For example, Patent Literatures 1 and 2 propose high-strength SR materials having workability.

Patent Literature 1 proposes a steel sheet for cans having a composition containing, in mass percent, C: 0.03% to 0.13%, Si: 0.03% or less, Mn: 0.3% to 0.6%, P: 0.02% or less, Al: 0.1% or less, N: 0.012% or less, and one or more of Nb: 0.005% to 0.05%, Ti: 0.005% to 0.05%, and B: 0.0005% to 0.005%, the remainder being iron and inevitable impurities, and a ferrite microstructure having a cementite ratio of 0.5% or more. The steel sheet for cans has an average ferrite grain size of 7 μm or less, a tensile strength of 450 MPa to 550 MPa after lacquer baking treatment, a total elongation of 20% or more, and a yield elongation of 5% or less.

Patent Literature 2 proposes a steel sheet for cans containing, in weight percent, C: 0.020% to 0.150%, Si: 0.05% or less, Mn: 1.00% or less, P: 0.050% or less, S: 0.010% or less, N: 0.0100% or less, Al: 0.100% or less, and Nb: 0.005% to 0.025%, the remainder being iron and inevitable impurities, being substantially a ferrite single-phase microstructure, and having a yield strength of 40 kgf/mm$^2$ or more, an average grain size of 10 μm or less, and a thickness of 0.300 mm or less. The steel sheet for cans has excellent deep drawability and flange formability in can making, excellent surface properties after can making, and sufficient can strength.

PATENT LITERATURE

PTL 1: Japanese Unexamined Patent Application Publication No. 2008-274332

PTL 2: Japanese Unexamined Patent Application Publication No. 8-325670

SUMMARY OF THE INVENTION

However, the above conventional techniques have problems below.

The technique described in Patent Literature 1 can be applied only to steel sheets with a tensile strength of up to 550 MPa and cannot cope with further thickness reduction. The uniform elongation required for rivetability is insufficient. Furthermore, the technique described in Patent Literature 2 has a problem that both an increase in tensile strength to 550 MPa or more and sufficient elongation cannot be ensured.

Aspects of the present invention have been made in view of the above circumstances and has an object to provide a steel sheet for cans with high strength and excellent workability and a method for manufacturing the same.

In order to achieve the above object, aspects of the present invention, in summary, are provided below.

(1) A steel sheet for cans which has a chemical composition containing, in mass percent,
C: 0.085% to 0.130%,
Si: 0.04% or less,
Mn: 0.10% to 0.60%,
P: 0.02% or less,
S: more than 0.010% to 0.020%,
Al: 0.02% to 0.10%,
N: 0.0005% to 0.0040%,
Nb: 0.007% to 0.030%, and
B: 0.0010% to 0.0050%,
B/N that is the ratio of the content (mass percent) of B to the content (mass percent) of N being 0.80 or more, the remainder being Fe and inevitable impurities, and
a ferrite microstructure containing 1.0% or more pearlite in terms of area fraction.
The steel sheet for cans has a yield stress of 500 MPa or more, a tensile strength of 550 MPa or more, a uniform elongation of 10% or more, and a yield elongation of 5.0% or less.

(2) In the steel sheet for cans specified in Item (1), the content of B is more than 0.0020% to 0.0050% in mass percent.

(3) In the steel sheet for cans specified in Item (1) or (2), the chemical composition further contains, in mass percent, one or more selected from
Ti: 0.005% to 0.030% and
Mo: 0.01% to 0.05%.

(4) A method for manufacturing the steel sheet for cans specified in any one of Items (1) to (3) which includes
a heating step of heating a steel slab having the chemical composition at a heating temperature of 1,100° C. or higher, a hot rolling step of hot-rolling a steel slab after the heating step under conditions including a finish hot rolling temperature of 830° C. to 940° C., a coiling step of coiling a hot-rolled sheet obtained in the hot rolling step at a coiling temperature of 400° C. to lower than 550° C., a pickling step of pickling a hot-rolled sheet after the coiling step, a cold rolling step of cold-rolling a hot-rolled sheet after the pickling step under conditions including a rolling reduction of 85% or more, an annealing step of annealing a cold-rolled sheet obtained in the cold rolling step under conditions including an annealing temperature of 720° C. to 780° C., and a temper rolling step of rolling an annealed sheet obtained in the annealing step under conditions including an elongation percentage of 0.5% to 5.0%.

A steel sheet for cans according to aspects of the present invention has high strength and excellent workability. According to aspects of the present invention, the further reduction in thickness of a steel sheet used for food cans, beverage cans, and the like is possible and resource saving and cost reduction can be achieved.

DETAILED DESCRIPTION OF EMBODIMENTS OF THE INVENTION

The chemical composition, steel sheet microstructure, and steel sheet characteristics of a steel sheet for cans according to aspects of the present invention and a method for manufacturing the steel sheet for cans are described below in the order. The present invention is not limited to embodiments below.

First, the chemical composition of the steel sheet for cans according to aspects of the present invention is described. In the description of the chemical composition, % used to express the content of each component refers to mass percent. The steel sheet for cans according to aspects of the present invention is also simply referred to as the steel sheet.

C: 0.085% to 0.130%

C is an important element that contributes, by forming pearlite, to the reduction of the yield elongation and the increase of the uniform elongation in addition to the increase of the yield stress and the tensile strength. Setting the content of C to 0.085% or more allows the area fraction of pearlite in the steel sheet microstructure to be 1.0% or more, the yield stress of the steel sheet to be 500 MPa or more, and the tensile strength to be 550 MPa or more. The C content is preferably 0.100% or more. However, when the C content is more than 0.130%, the yield elongation increases and the uniform elongation decreases because the amount of solute C increases. Therefore, the C content needs to be 0.130% or less. The C content is preferably 0.125% or less.

Si: 0.04% or Less

Adding a large amount of Si deteriorates the surface treatability because of the concentration in the surface and deteriorates the corrosion resistance. Therefore, the content of Si needs to be 0.04% or less. The Si content is preferably 0.03% or less. However, Si contributes to the increase of the yield stress and the tensile strength and therefore 0.01% or more Si is preferably added.

Mn: 0.10% to 0.60%

Mn not only contributes to the increase of the yield stress and the tensile strength due to solid solution strengthening but also promotes the formation of pearlite. This accelerates work hardening, thereby enabling, in addition to a tensile strength of 550 MPa or more, a yield elongation of 5.0% or less and a uniform elongation of 10% or more to be obtained. In order to obtain such an effect, the content of Mn needs to be 0.10% or more. The Mn content is preferably 0.30% or more. However, when the Mn content is more than 0.60%, not only the contribution to the formation of pearlite is not further obtained, but also the uniform elongation is reduced by excessive solid solution strengthening. Therefore, the upper limit of the Mn content needs to be 0.60%. The Mn content is preferably 0.55% or less.

P: 0.02% or Less

When a large amount of P is contained, the workability deteriorates by excessive hardening and central segregation and the corrosion resistance deteriorates. Therefore, the upper limit of the content of P is 0.02%. However, P contributes to the increase of the yield stress and the tensile strength and therefore the P content is preferably 0.005% or more. The P content is more preferably 0.010% or more.

S: more than 0.010% to 0.020%

S forms sulfides in steel to deteriorate hot rolling properties. Thus, the content of S is 0.020% or less. When the S content is 0.010% or less, pitting corrosion may possibly occur depending on contents of cans. Therefore, the S content needs to be more than 0.010%.

Al: 0.02% to 0.10%

Al is useful as a deoxidizing element and forms nitrides to contribute to the reduction of the yield elongation. Therefore, 0.02% or more Al needs to be contained. The content of Al is preferably 0.03% or more. However, when Al is excessively contained, a large amount of alumina is formed and remains in the steel sheet to deteriorate the workability. Therefore, the Al content needs to be 0.10% or less. The Al content is preferably 0.08% or less.

N: 0.0005% to 0.0040%

The presence of N in the form of solute N increases the yield elongation and deteriorates the workability. Therefore, the content of N needs to be 0.0040% or less. The N content is preferably 0.0035% or less. However, stably keeping the N content less than 0.0005% is difficult and increases manufacturing costs. Therefore, the lower limit of the N content is 0.0005%.

Nb: 0.007% to 0.030%

Nb is an important element that increases the yield stress and the tensile strength by the refinement of ferrite grains and the formation of carbides. In order to such an effect, the content of Nb needs to be 0.007% or more. The Nb content is preferably 0.010% or more. However, when more than 0.030% Nb is contained, the recrystallization temperature is excessively high and it is difficult to ensure both the tensile strength and the uniform elongation. Therefore, the upper limit of the Nb content needs to be 0.030%. The Nb content is preferably 0.026% or less.

B: 0.0010% to 0.0050%, B/N: 0.80 or More

B forms BN with N to reduce the amount of solute N and therefore has the effect of reducing the yield elongation. In addition, the presence of solute B refines ferrite grains to contribute to the increase of the yield stress. Therefore, the content of B needs to be 0.0010% or more. The B content is preferably more than 0.0020%. In addition, if a certain amount or more of B is not contained with respect to N, then such an effect is not obtained. Therefore, B/N that is the content ratio of B to N [the ratio of the content (mass percent) of B to the content (mass percent) of N] needs to be 0.80 or more. B/N is preferably 1.00 or more and more preferably 1.20 or more. The upper limit of B/N is not particularly determined and B/N is preferably 5.00 or less and more preferably 3.00 or less from the viewpoint that better tensile characteristics are likely to be exhibited. Even if B is excessively contained, not only there is no further effect, but also the uniform elongation decreases, the anisotropy deteriorates, and the workability deteriorates. Therefore, the upper limit of the B content needs to be 0.0050%. The B content is preferably 0.0040% or less.

The steel sheet for cans according to aspects of the present invention may have a chemical composition containing the above components, the remainder being Fe and inevitable impurities.

The steel sheet for cans according to aspects of the present invention preferably contains one or more selected from Ti: 0.005% to 0.030% and Mo: 0.01% to 0.05% in addition to the above chemical composition.

Ti: 0.005% to 0.030%

Ti has the effect of fixing N in the form of TiN to reduce the yield elongation. Ti preferentially produces TiN to suppress the production of BN and refines ferrite grains by ensuring solute B to contribute to the increase of the yield stress and the tensile strength. Furthermore, Ti forms fine carbides to contribute to the increase of the yield stress and the tensile strength. Therefore, when Ti is contained, the content of Ti is preferably 0.005% or more. The Ti content is more preferably 0.010% or more. However, when more than 0.030% Ti is contained, the recrystallization temperature is excessively high and it is difficult to ensure both the tensile strength and the uniform elongation. Therefore, when Ti is contained, the Ti content is preferably 0.030% or less. The Ti content is more preferably 0.020% or less.

Mo: 0.01% to 0.05%

Mo contributes to the increase of the yield stress and the tensile strength by the refinement of ferrite grains and the formation of carbides. Therefore, when Mo is contained, the content of Mo is preferably 0.01% or more. The Mo content is more preferably 0.02% or more. However, when more than 0.05% Mo is contained, not only such an effect cannot be further obtained, but also grain boundary segregation is excessive, and the uniform elongation decreases. Therefore, when Mo is contained, the upper limit of the Mo content is preferably 0.05%.

Next, the steel sheet microstructure of the steel sheet for cans according to aspects of the present invention is described.

Area Fraction of Pearlite: 1.0% or More

Containing pearlite such that pearlite is dispersed in the steel sheet microstructure promotes work hardening. This allows, in addition to a tensile strength of 550 MPa or more, a yield elongation of 5.0% or less and a uniform elongation of 10% or more to be obtained, thereby obtaining good workability. In order to obtain such an effect, the area fraction of pearlite in the steel sheet microstructure needs to be 1.0% or more. The area fraction of pearlite is preferably 1.5% or more and more preferably 2.0% or more. The area fraction of pearlite is preferably 10% or less and more preferably 5.0% or less. The microstructure of the steel sheet for cans according to aspects of the present invention is such that a ferrite microstructure is a main phase and the rest other than the pearlite is the ferrite microstructure (ferrite phase). The ferrite microstructure may contain granular cementite.

A sample used to observe the steel sheet microstructure is cut from the steel sheet such that a perpendicular section of the steel sheet that is parallel to the rolling direction of the steel sheet can be observed. The sample is embedded in resin. After an observation surface of the sample is polished and is then etched with nital such that the microstructure is revealed, the steel sheet microstructure is photographed at a ½ position of the thickness of the steel sheet by using a scanning electron microscope and the area fraction of pearlite is measured by image processing. In particular, the steel sheet microstructure is photographed in three fields of view selected at random at 3,000× magnification using the scanning electron microscope, the area fraction of pearlite is measured by image processing from each SEM image, and the average is determined.

Next, steel sheet characteristics of the steel sheet for cans according to aspects of the present invention are described.

Yield stress: 500 MPa or more, tensile strength: 550 MPa or more, yield elongation: 5.0% or less, uniform elongation: 10% or more In order to ensure sufficient can strength in thinned cans, the yield stress and tensile strength of the steel sheet need to be 500 MPa or more and 550 MPa or more, respectively. The yield stress is preferably 510 MPa or more. The tensile strength is preferably 570 MPa or more. The upper limit of the yield stress is not particularly limited and the yield stress is preferably 590 MPa or less from the viewpoint of curling properties of lids. The upper limit of the tensile strength is not particularly limited and the tensile strength is preferably 650 MPa or less from the viewpoint of the openability of easy open ends. In order to prevent the stretcher strain in can making or lid making, the yield elongation needs to be 5.0% or less. The yield elongation is preferably 4.0% or less. In order to ensure the neck formability and flange formability of can bodies and the rivetability of easy open ends, the uniform elongation needs to be 10% or more. The uniform elongation is preferably 12% or more. In addition, the percentage elongation after fracture (EL) is preferably 15% or more. The percentage elongation after fracture is more preferably 18% or more.

In accordance with aspects of the present invention, the yield stress, the tensile strength, the uniform elongation, the yield elongation, and the percentage elongation after fracture are evaluated in such a manner that a JIS No. 5 tensile specimen is taken in the rolling direction, is subjected to an aging heat treatment at 210° C. for 20 minutes, and is then evaluated in accordance with JIS Z 2241. The yield stress is evaluated using the upper yield stress when the upper yield point is present, and the yield stress is evaluated using the 0.2%-proof stress when the upper yield point is not present. The uniform elongation is evaluated using the percentage total extension at maximum force specified in JIS Z 2241.

The thickness of the steel sheet for cans according to aspects of the present invention is not particularly limited and is preferably 0.40 mm or less. The steel sheet for cans according to aspects of the present invention can be gauged down to an extremely thin level and preferably has a thickness of 0.25 mm or less from the viewpoint of resource saving and cost reduction. The thickness thereof is preferably 0.10 mm or more.

Next, a method for manufacturing the steel sheet for cans according to aspects of the present invention is described. The steel sheet for cans can be manufactured under conditions described below. The steel sheet for cans, which is manufactured by a method below, may be appropriately subjected to a step such as a coating step of performing Sn coating, Ni coating, Cr coating, or the like; a chemical conversion step; or a resin-coating step such as a lamination step.

Heating Temperature: 1,100° C. or Higher

A steel slab having the above chemical composition is heated at a heating temperature of 1,100° C. or higher (a heating step). When the heating temperature of the steel slab before hot rolling is too low, coarse nitrides may possibly be produced to deteriorate the workability. Therefore, the heating temperature of the steel slab is 1,100° C. or higher. The heating temperature of the steel slab is preferably 1,150° C. or higher. When the steel slab contains Ti, the heating temperature of the steel slab is more preferably 1,200° C. or higher. The heating temperature of the steel slab is preferably 1,280° C. or lower from the viewpoint of obtaining better surface condition.

Finishing Temperature: 830° C. to 940° C.

The steel slab after the heating step is hot-rolled under conditions including a finish hot rolling temperature of 830° C. to 940° C. (a hot-rolling step). When the finishing temperature (finish hot rolling temperature) in hot rolling is higher than 940° C., ferrite grains in a hot-rolled sheet coarsen and ferrite grains after cold rolling, annealing, or temper rolling coarsen to reduce the yield stress and the tensile strength. In addition, the formation of scale may possibly be promoted to deteriorate surface properties. Therefore, the upper limit of the finish hot rolling temperature is 940° C. The upper limit of the finish hot rolling temperature is preferably 920° C. However, when the finish hot rolling temperature is lower than 830° C., coarse Nb carbides are formed in hot rolling to reduce the yield stress and the tensile strength. Therefore, the lower limit of the finish hot rolling temperature is 830° C. The lower limit of the finish hot rolling temperature is preferably 850° C.

Coiling Temperature: 400° C. to Lower than 550° C.

The hot-rolled sheet, which is obtained in the hot-rolling step, is coiled and a coiling temperature of 400° C. to lower than 550° C. (a coiling step). When the coiling temperature is 550° C. or higher, cementite in the hot-rolled sheet coarsens, stabilizes, and remains undissolved during annealing to reduce the fraction of pearlite. In addition, alloy carbides such as Nb carbides coarsen to reduce the yield stress and the tensile strength. Therefore, the coiling temperature needs to be lower than 550° C. The coiling temperature is preferably 530° C. or lower. However, when the coiling temperature is lower than 400° C., precipitation of alloy carbides of Nb, for example, is suppressed and the yield stress and the tensile strength decrease. Therefore, the lower limit of the coiling temperature is 400° C. The coiling temperature is preferably 470° C. or higher. Thereafter, the hot-rolled sheet after the coiling step is pickled (a pickling step). Pickling conditions are not particularly limited.

Rolling Reduction: 85% or More

The hot-rolled sheet after the pickling step is cold-rolled under conditions including a rolling reduction of 85% or more (a cold rolling step). Cold rolling refines ferrite grains after annealing to increase the yield stress and the tensile strength. In order to obtain this effect, the rolling reduction in cold rolling is 85% or more. The rolling reduction is preferably 87% or more. The upper limit of the rolling reduction in cold rolling is not particularly limited. The rolling reduction in cold rolling is preferably 93% or less from the viewpoint of obtaining better workability.

Annealing Temperature: 720° C. to 780° C.

A cold-rolled sheet obtained in the cold rolling step is annealed under conditions including an annealing temperature of 720° C. to 780° C. (an annealing step). In order to obtain high tensile strength, high uniform elongation, and low yield elongation, it is important to form pearlite in the course of annealing. Therefore, the annealing temperature needs to be 720° C. or higher. The annealing temperature is preferably 730° C. or higher. However, when the annealing temperature is higher than 780° C., alloy carbides such as Nb carbides coarsen and ferrite grains also coarsen to reduce the yield stress and the tensile strength. Therefore, the upper limit of the annealing temperature needs to be 780° C. The annealing temperature is preferably 760° C. or lower. An annealing method is preferably continuous annealing from the viewpoint of material homogeneity. The annealing time is not particularly limited and is preferably 15 s or more. The annealing time is preferably 60 s or less from the viewpoint of the refinement of ferrite grains.

Elongation Percentage in Temper Rolling: 0.5% to 5.0%

An annealed sheet obtained in the annealing step is rolled under conditions including an elongation percentage of 0.5% to 5.0% (a temper rolling step). Temper rolling after annealing adjusts the surface roughness, corrects the sheet shape, introduces strain into the steel sheet to increase the yield stress, and reduces the yield elongation. In order to obtain such an effect, the lower limit of the rolling reduction (elongation percentage) in temper rolling is 0.5%. The elongation percentage is preferably 1.2% or more. However, when the elongation percentage is more than 5.0%, strain is excessively introduced and the uniform elongation decreases. Therefore, the upper limit of the elongation percentage is 5.0%. The elongation percentage is preferably 3.0% or less.

Example 1

An example of the present invention is described below. The technical scope of the present invention is not limited to the example below.

Steels containing components of Steels No. 1 to 41 illustrated in Table 1, the remainder being Fe and inevitable impurities, were produced and steel slabs were obtained. The obtained steel slabs were heated, hot-rolled, coiled, descaled by pickling, cold-rolled, annealed in a continuous annealing furnace, and then temper-rolled under conditions illustrated in Table 2, whereby steel sheets for cans (Steel Sheets No. 1 to 49) were obtained.

(Evaluation of Yield Stress, Tensile Strength, Uniform Elongation, Yield Elongation, and Percentage Elongation after Fracture)

JIS No. 5 tensile specimens were taken from the steel sheets for cans along the rolling direction, were subjected to an aging heat treatment at 210° C. for 20 minutes, and were then evaluated for yield stress, tensile strength, uniform elongation, yield elongation, and percentage elongation after fracture in accordance with JIS Z 2241. Evaluation results were illustrated in Table 3.

(Measurement of Area Fraction of Pearlite)

A sample used to observe the steel sheet microstructure was cut from each steel sheet for cans such that a perpendicular section of the steel sheet that was parallel to the rolling direction of the steel sheet could be observed. The sample was embedded in resin. After an observation surface of the sample was polished, the observation surface thereof was etched with nital such that the microstructure was revealed. The steel sheet microstructure was photographed at a ½ position of the thickness of the steel sheet in three fields of view selected at random at 3,000× magnification using a scanning electron microscope, the area fraction of pearlite was measured from each SEM image by image processing, and the average is determined. Measurement results were illustrated in Table 3.

TABLE 1

| Steel No. | Chemical Composition (mass percent) | | | | | | | | | | | | Remarks |
|---|---|---|---|---|---|---|---|---|---|---|---|---|---|
| | C | Si | Mn | P | S | Al | N | Nb | B | Ti | Mo | B/N | |
| 1 | 0.115 | 0.01 | 0.55 | 0.015 | 0.012 | 0.04 | 0.0026 | 0.016 | 0.0028 | — | — | 1.08 | Inventive steel |
| 2 | 0.102 | 0.01 | 0.45 | 0.011 | 0.011 | 0.05 | 0.0022 | 0.015 | 0.0026 | — | — | 1.18 | Inventive steel |
| 3 | 0.120 | 0.02 | 0.56 | 0.013 | 0.011 | 0.05 | 0.0026 | 0.015 | 0.0025 | — | — | 0.96 | Inventive steel |
| 4 | 0.130 | 0.02 | 0.55 | 0.017 | 0.013 | 0.09 | 0.0018 | 0.012 | 0.0026 | — | — | 1.44 | Inventive steel |
| 5 | 0.110 | 0.01 | 0.12 | 0.018 | 0.011 | 0.08 | 0.0031 | 0.012 | 0.0035 | — | — | 1.13 | Inventive steel |
| 6 | 0.120 | 0.01 | 0.30 | 0.008 | 0.012 | 0.07 | 0.0017 | 0.012 | 0.0027 | — | — | 1.59 | Inventive steel |
| 7 | 0.120 | 0.01 | 0.60 | 0.015 | 0.017 | 0.03 | 0.0031 | 0.018 | 0.0040 | — | — | 1.29 | Inventive steel |
| 8 | 0.115 | 0.01 | 0.45 | 0.017 | 0.019 | 0.03 | 0.0039 | 0.018 | 0.0047 | — | — | 1.21 | Inventive steel |
| 9 | 0.123 | 0.03 | 0.32 | 0.02 | 0.011 | 0.06 | 0.0031 | 0.010 | 0.0047 | — | — | 1.52 | Inventive steel |
| 10 | 0.106 | 0.01 | 0.40 | 0.014 | 0.016 | 0.08 | 0.0037 | 0.007 | 0.0039 | — | — | 1.05 | Inventive steel |
| 11 | 0.124 | 0.01 | 0.50 | 0.019 | 0.013 | 0.07 | 0.0019 | 0.030 | 0.0024 | — | — | 1.26 | Inventive steel |
| 12 | 0.119 | 0.01 | 0.54 | 0.018 | 0.013 | 0.02 | 0.0015 | 0.022 | 0.0021 | — | — | 1.40 | Inventive steel |
| 13 | 0.110 | 0.01 | 0.33 | 0.014 | 0.015 | 0.03 | 0.0023 | 0.026 | 0.0041 | — | — | 1.78 | Inventive steel |
| 14 | 0.121 | 0.01 | 0.55 | 0.009 | 0.020 | 0.08 | 0.0037 | 0.020 | 0.0050 | — | — | 1.35 | Inventive steel |
| 15 | 0.118 | 0.02 | 0.58 | 0.018 | 0.017 | 0.08 | 0.0035 | 0.018 | 0.0027 | — | — | 0.77 | Comparative steel |
| 16 | 0.109 | 0.01 | 0.54 | 0.008 | 0.015 | 0.05 | 0.0034 | 0.012 | 0.0028 | — | — | 0.82 | Inventive steel |
| 17 | 0.080 | 0.01 | 0.55 | 0.013 | 0.008 | 0.03 | 0.0012 | 0.016 | 0.0026 | — | — | 2.17 | Comparative steel |
| 18 | 0.151 | 0.01 | 0.54 | 0.011 | 0.018 | 0.05 | 0.0027 | 0.016 | 0.0030 | — | — | 1.11 | Comparative steel |
| 19 | 0.120 | 0.01 | 0.03 | 0.011 | 0.008 | 0.06 | 0.0034 | 0.016 | 0.0031 | — | — | 0.91 | Comparative steel |
| 20 | 0.123 | 0.01 | 0.73 | 0.011 | 0.010 | 0.08 | 0.0010 | 0.016 | 0.0021 | — | — | 2.10 | Comparative steel |
| 21 | 0.128 | 0.01 | 0.43 | 0.019 | 0.017 | 0.02 | 0.0052 | 0.016 | 0.0049 | — | — | 0.94 | Comparative steel |
| 22 | 0.127 | 0.01 | 0.58 | 0.017 | 0.012 | 0.04 | 0.0013 | 0.003 | 0.0036 | — | — | 2.77 | Comparative steel |
| 23 | 0.113 | 0.01 | 0.54 | 0.016 | 0.020 | 0.09 | 0.0019 | 0.045 | 0.0021 | — | — | 1.11 | Comparative steel |
| 24 | 0.109 | 0.01 | 0.55 | 0.015 | 0.013 | 0.09 | 0.0019 | 0.015 | 0.0010 | — | — | 0.53 | Comparative steel |
| 25 | 0.105 | 0.01 | 0.37 | 0.011 | 0.009 | 0.03 | 0.0038 | 0.015 | 0.0066 | — | — | 1.74 | Comparative steel |
| 26 | 0.114 | 0.01 | 0.51 | 0.008 | 0.014 | 0.09 | 0.0010 | 0.017 | 0.0025 | 0.010 | — | 2.50 | Inventive steel |
| 27 | 0.124 | 0.01 | 0.47 | 0.012 | 0.015 | 0.02 | 0.0026 | 0.017 | 0.0042 | 0.012 | — | 1.62 | Inventive steel |
| 28 | 0.119 | 0.03 | 0.45 | 0.012 | 0.020 | 0.02 | 0.0029 | 0.015 | 0.0036 | 0.019 | — | 1.24 | Inventive steel |
| 29 | 0.122 | 0.01 | 0.55 | 0.014 | 0.016 | 0.06 | 0.0020 | 0.023 | 0.0033 | 0.030 | — | 1.65 | Inventive steel |
| 30 | 0.115 | 0.01 | 0.49 | 0.019 | 0.018 | 0.02 | 0.0031 | 0.019 | 0.0036 | 0.050 | — | 1.16 | Comparative steel |
| 31 | 0.117 | 0.01 | 0.50 | 0.008 | 0.020 | 0.02 | 0.0011 | 0.020 | 0.0029 | — | 0.01 | 2.64 | Inventive steel |
| 32 | 0.109 | 0.01 | 0.38 | 0.017 | 0.012 | 0.06 | 0.0020 | 0.018 | 0.0031 | — | 0.02 | 1.55 | Inventive steel |
| 33 | 0.104 | 0.01 | 0.42 | 0.013 | 0.016 | 0.02 | 0.0034 | 0.014 | 0.0034 | — | 0.05 | 1.00 | Inventive steel |
| 34 | 0.122 | 0.01 | 0.50 | 0.011 | 0.010 | 0.07 | 0.0029 | 0.026 | 0.0028 | — | 0.08 | 0.97 | Comparative steel |
| 35 | 0.103 | 0.01 | 0.57 | 0.011 | 0.015 | 0.02 | 0.0025 | 0.014 | 0.0030 | 0.018 | 0.03 | 1.20 | Inventive steel |
| 36 | 0.121 | 0.01 | 0.55 | 0.019 | 0.017 | 0.07 | 0.0011 | 0.018 | 0.0027 | 0.013 | 0.02 | 2.45 | Inventive steel |
| 37 | 0.118 | 0.01 | 0.50 | 0.013 | 0.011 | 0.05 | 0.0011 | 0.016 | 0.0010 | — | — | 0.91 | Inventive steel |
| 38 | 0.112 | 0.01 | 0.50 | 0.015 | 0.011 | 0.06 | 0.0017 | 0.015 | 0.0014 | — | — | 0.82 | Inventive steel |
| 39 | 0.085 | 0.01 | 0.52 | 0.014 | 0.012 | 0.05 | 0.0026 | 0.016 | 0.0023 | — | — | 0.88 | Inventive steel |
| 40 | 0.092 | 0.01 | 0.50 | 0.014 | 0.012 | 0.05 | 0.0023 | 0.015 | 0.0028 | — | — | 1.22 | Inventive steel |
| 41 | 0.113 | 0.01 | 0.48 | 0.015 | 0.013 | 0.06 | 0.0024 | 0.015 | 0.0003 | — | — | 0.13 | Comparative steel |

Underlines indicate values outside the scope of the present invention.

TABLE 2

| Steel sheet No. | Steel No. | Heating temperature (° C.) | Finishing temperature (° C.) | Coiling temperature (° C.) | Rolling reduction (%) | Annealing temperature (° C.) | Annealing time (s) | Elongation (%) | Thickness (mm) |
|---|---|---|---|---|---|---|---|---|---|
| 1 | 1 | 1180 | 880 | 530 | 89.9 | 740 | 20 | 1.2 | 0.20 |
| 2 | 1 | 1180 | 810 | 530 | 89.9 | 740 | 20 | 1.2 | 0.20 |
| 3 | 1 | 1180 | 970 | 530 | 89.9 | 740 | 20 | 1.2 | 0.20 |
| 4 | 1 | 1180 | 880 | 580 | 89.9 | 740 | 20 | 1.2 | 0.20 |
| 5 | 1 | 1180 | 880 | 350 | 89.9 | 740 | 20 | 1.2 | 0.20 |
| 6 | 1 | 1180 | 880 | 530 | 89.9 | 700 | 20 | 1.2 | 0.20 |
| 7 | 1 | 1180 | 880 | 530 | 89.9 | 820 | 20 | 1.2 | 0.20 |
| 8 | 1 | 1180 | 880 | 530 | 88.9 | 740 | 20 | 10 | 0.20 |
| 9 | 1 | 1180 | 880 | 530 | 90.0 | 740 | 20 | 0.3 | 0.20 |
| 10 | 2 | 1100 | 940 | 540 | 87.8 | 750 | 15 | 1.5 | 0.24 |
| 11 | 3 | 1200 | 870 | 540 | 87.3 | 750 | 15 | 1.5 | 0.25 |
| 12 | 4 | 1200 | 870 | 500 | 87.3 | 730 | 15 | 1.5 | 0.25 |
| 13 | 5 | 1200 | 860 | 450 | 88.4 | 720 | 25 | 5.0 | 0.22 |
| 14 | 6 | 1200 | 890 | 480 | 88.8 | 725 | 25 | 2.0 | 0.22 |
| 15 | 7 | 1200 | 830 | 480 | 89.9 | 750 | 25 | 1.2 | 0.18 |
| 16 | 8 | 1200 | 900 | 500 | 89.9 | 740 | 30 | 1.2 | 0.18 |
| 17 | 9 | 1200 | 850 | 500 | 92.4 | 740 | 30 | 1.4 | 0.15 |
| 18 | 10 | 1200 | 850 | 500 | 92.3 | 740 | 20 | 3.0 | 0.15 |
| 19 | 11 | 1200 | 860 | 520 | 89.2 | 730 | 20 | 3.0 | 0.21 |
| 20 | 12 | 1200 | 860 | 520 | 89.4 | 730 | 40 | 0.8 | 0.21 |
| 21 | 13 | 1200 | 860 | 520 | 89.9 | 750 | 20 | 1.0 | 0.20 |
| 22 | 14 | 1200 | 880 | 490 | 89.9 | 750 | 20 | 0.5 | 0.20 |
| 23 | 15 | 1200 | 900 | 530 | 89.9 | 740 | 20 | 1.2 | 0.20 |
| 24 | 16 | 1150 | 900 | 530 | 89.9 | 740 | 20 | 1.2 | 0.20 |

TABLE 2-continued

| Steel sheet No. | Steel No. | Heating temperature (° C.) | Finishing temperature (° C.) | Coiling temperature (° C.) | Rolling reduction (%) | Annealing temperature (° C.) | Annealing time (s) | Elongation (%) | Thickness (mm) |
|---|---|---|---|---|---|---|---|---|---|
| 25 | 17 | 1210 | 890 | 530 | 89.9 | 740 | 20 | 1.2 | 0.20 |
| 26 | 18 | 1210 | 890 | 530 | 89.9 | 740 | 20 | 1.2 | 0.20 |
| 27 | 19 | 1210 | 890 | 530 | 89.9 | 740 | 20 | 1.2 | 0.20 |
| 28 | 20 | 1210 | 890 | 530 | 89.9 | 740 | 20 | 1.2 | 0.20 |
| 29 | 21 | 1210 | 890 | 530 | 89.9 | 740 | 20 | 1.2 | 0.20 |
| 30 | 22 | 1210 | 890 | 530 | 89.9 | 740 | 20 | 1.2 | 0.20 |
| 31 | 23 | 1210 | 880 | 530 | 89.9 | 740 | 20 | 1.2 | 0.20 |
| 32 | 24 | 1210 | 880 | 530 | 89.9 | 740 | 20 | 1.2 | 0.20 |
| 33 | 25 | 1210 | 880 | 530 | 89.9 | 740 | 20 | 1.2 | 0.20 |
| 34 | 26 | 1230 | 910 | 520 | 90.4 | 740 | 20 | 1.4 | 0.17 |
| 35 | 27 | 1230 | 900 | 520 | 90.4 | 740 | 20 | 1.4 | 0.17 |
| 36 | 28 | 1200 | 920 | 520 | 90.4 | 740 | 20 | 1.4 | 0.17 |
| 37 | 29 | 1250 | 870 | 520 | 90.4 | 740 | 20 | 1.4 | 0.17 |
| 38 | 30 | 1190 | 880 | 520 | 90.4 | 740 | 20 | 1.4 | 0.17 |
| 39 | 31 | 1190 | 880 | 490 | 90.4 | 740 | 20 | 1.4 | 0.17 |
| 40 | 32 | 1190 | 880 | 490 | 90.4 | 740 | 20 | 1.4 | 0.17 |
| 41 | 33 | 1190 | 880 | 490 | 90.4 | 740 | 20 | 1.4 | 0.17 |
| 42 | 34 | 1190 | 880 | 490 | 90.4 | 740 | 20 | 1.4 | 0.17 |
| 43 | 35 | 1230 | 910 | 510 | 90.4 | 750 | 15 | 2.0 | 0.17 |
| 44 | 36 | 1250 | 890 | 510 | 90.4 | 750 | 15 | 2.0 | 0.17 |
| 45 | 37 | 1230 | 870 | 520 | 89.8 | 740 | 20 | 1.5 | 0.20 |
| 46 | 38 | 1230 | 880 | 520 | 89.8 | 740 | 20 | 1.6 | 0.20 |
| 47 | 39 | 1210 | 880 | 530 | 89.9 | 740 | 20 | 1.2 | 0.20 |
| 48 | 40 | 1210 | 890 | 520 | 89.9 | 740 | 20 | 1.2 | 0.20 |
| 49 | 41 | 1200 | 880 | 530 | 89.9 | 740 | 20 | 1.2 | 0.20 |

Underlines indicate values outside the scope of the present invention.

TABLE 3

| Steel sheet No. | Steel No. | Yield stress MPa | Yield elongation % | Tensile strength MPa | Uniform elongation % | Percentage elongation after fracture % | Area fraction of pearlite % | Remarks |
|---|---|---|---|---|---|---|---|---|
| 1 | 1 | 515 | 4.2 | 570 | 14 | 22 | 2.5 | Inventive example |
| 2 | 1 | 482 | 5.3 | 530 | 12 | 26 | 2.4 | Comparative example |
| 3 | 1 | 478 | 5.6 | 536 | 11 | 24 | 2.4 | Comparative example |
| 4 | 1 | 475 | 3.3 | 520 | 8 | 25 | 0.6 | Comparative example |
| 5 | 1 | 463 | 6.3 | 522 | 13 | 23 | 1.1 | Comparative example |
| 6 | 1 | 570 | 0.6 | 610 | 5 | 9 | 0 | Comparative example |
| 7 | 1 | 623 | 0.2 | 664 | 1 | 6 | 0 | Comparative example |
| 8 | 1 | 596 | 0.3 | 642 | 2 | 5 | 2.5 | Comparative example |
| 9 | 1 | 491 | 6.7 | 563 | 13 | 21 | 2.5 | Comparative example |
| 10 | 2 | 504 | 3.6 | 553 | 12 | 26 | 1.8 | Inventive example |
| 11 | 3 | 517 | 4.3 | 573 | 13 | 23 | 2.3 | Inventive example |
| 12 | 4 | 520 | 2.9 | 580 | 15 | 25 | 3.2 | Inventive example |
| 13 | 5 | 505 | 4.4 | 552 | 11 | 26 | 1.7 | Inventive example |
| 14 | 6 | 508 | 4.0 | 563 | 12 | 23 | 1.9 | Inventive example |
| 15 | 7 | 535 | 4.1 | 591 | 13 | 21 | 3.6 | Inventive example |
| 16 | 8 | 532 | 4.6 | 578 | 13 | 22 | 2.0 | Inventive example |
| 17 | 9 | 509 | 3.6 | 556 | 14 | 23 | 1.6 | Inventive example |
| 18 | 10 | 511 | 4.3 | 560 | 15 | 25 | 2.4 | Inventive example |
| 19 | 11 | 542 | 2.9 | 603 | 12 | 20 | 1.6 | Inventive example |
| 20 | 12 | 510 | 4.1 | 559 | 13 | 22 | 1.8 | Inventive example |
| 21 | 13 | 513 | 4.5 | 566 | 12 | 23 | 1.2 | Inventive example |
| 22 | 14 | 517 | 4.1 | 571 | 12 | 19 | 2.6 | Inventive example |
| 23 | 15 | 486 | 7.2 | 534 | 10 | 23 | 2.7 | Comparative example |
| 24 | 16 | 510 | 4.3 | 564 | 13 | 23 | 2.9 | Inventive example |
| 25 | 17 | 467 | 5.2 | 521 | 9 | 20 | 0.7 | Comparative example |
| 26 | 18 | 520 | 8.4 | 578 | 8 | 19 | 2.2 | Comparative example |
| 27 | 19 | 490 | 6.3 | 539 | 9 | 20 | 0.8 | Comparative example |
| 28 | 20 | 536 | 0.6 | 579 | 8 | 18 | 3.3 | Comparative example |
| 29 | 21 | 524 | 7.6 | 563 | 8 | 15 | 2.8 | Comparative example |
| 30 | 22 | 469 | 3.9 | 526 | 10 | 21 | 2.7 | Comparative example |
| 31 | 23 | 576 | 2.3 | 620 | 7 | 12 | 3.1 | Comparative example |
| 32 | 24 | 519 | 7.3 | 546 | 8 | 19 | 2.2 | Comparative example |
| 33 | 25 | 480 | 3.6 | 539 | 8 | 18 | 3.4 | Comparative example |
| 34 | 26 | 535 | 2.8 | 593 | 13 | 21 | 2.3 | Inventive example |
| 35 | 27 | 542 | 2.8 | 600 | 13 | 21 | 2.1 | Inventive example |
| 36 | 28 | 555 | 2.6 | 610 | 12 | 20 | 2.1 | Inventive example |
| 37 | 29 | 560 | 2.7 | 625 | 10 | 19 | 1.6 | Inventive example |
| 38 | 30 | 602 | 4.6 | 680 | 8 | 14 | 0.7 | Comparative example |
| 39 | 31 | 526 | 2.4 | 582 | 13 | 20 | 3.1 | Inventive example |

TABLE 3-continued

| Steel sheet No. | Steel No. | Yield stress MPa | Yield elongation % | Tensile strength MPa | Uniform elongation % | Percentage elongation after fracture % | Area fraction of pearlite % | Remarks |
|---|---|---|---|---|---|---|---|---|
| 40 | 32 | 529 | 2.2 | 590 | 12 | 19 | 3.2 | Inventive example |
| 41 | 33 | 536 | 1.9 | 598 | 12 | 19 | 4.0 | Inventive example |
| 42 | 34 | 540 | 3.9 | 609 | 8 | 14 | 3.9 | Comparative example |
| 43 | 35 | 590 | 1.8 | 630 | 11 | 17 | 3.6 | Inventive example |
| 44 | 36 | 578 | 1.6 | 628 | 11 | 17 | 3.3 | Inventive example |
| 45 | 37 | 526 | 4.7 | 560 | 11 | 18 | 3.1 | Inventive example |
| 46 | 38 | 519 | 4.6 | 562 | 12 | 19 | 2.8 | Inventive example |
| 47 | 39 | 514 | 4.3 | 552 | 12 | 23 | 1.2 | Inventive example |
| 48 | 40 | 510 | 3.9 | 560 | 13 | 22 | 1.6 | Inventive example |
| 49 | 41 | 473 | 6.9 | 515 | 15 | 24 | 2.1 | Comparative example |

(*) A microstructure other than pearlite is ferrite.

Inventive examples all have a yield stress of 500 MPa or more, a tensile strength of 550 MPa or more, a uniform elongation of 10% or more, and a yield elongation of 5.0% or less. Thus, the inventive examples are steel sheets for cans having high uniform elongation, low yield elongation, and high strength.

However, comparative examples were poor in one or more of yield stress, tensile strength, uniform elongation, and yield elongation.

The invention claimed is:

1. A steel sheet for cans comprising:

a chemical composition containing, in mass percent,

C: 0.085% to 0.130%,

Si: 0.04% or less,

Mn: 0.10% to 0.60%,

P: 0.02% or less,

S: more than 0.010% to 0.020%,

Al: 0.02% to 0.10%,

N: 0.0005% to 0.0040%,

Nb: 0.007% to 0.030%, and

B: 0.0010% to 0.0050%,

B/N that is a ratio of a content of B in mass percent to a content of N in mass percent being 0.80 or more, the remainder being Fe and inevitable impurities; and a ferrite microstructure containing 1.0% or more pearlite in terms of area fraction, the steel sheet for cans having a yield stress of 500 MPa or more, a tensile strength of 550 MPa or more, a uniform elongation of 10% or more, and a yield elongation of 5.0% or less.

2. The steel sheet for cans according to claim 1, wherein the content of B is more than 0.0020% to 0.0050% in mass percent.

3. The steel sheet for cans according to claim 1, wherein the chemical composition further contains, in mass percent, one or more selected from Ti: 0.005% to 0.030% and Mo: 0.01% to 0.05%.

4. The steel sheet for cans according to claim 2, wherein the chemical composition further contains, in mass percent, one or more selected from Ti: 0.005% to 0.030% and Mo: 0.01% to 0.05%.

5. A method for manufacturing the steel sheet for cans according to claim 1, comprising:

a heating step of heating a steel slab having the chemical composition at a heating temperature of 1,100° C. or higher;

a hot rolling step of hot-rolling a steel slab after the heating step under conditions including a finish hot rolling temperature of 830° C. to 940° C.;

a coiling step of coiling a hot-rolled sheet obtained in the hot rolling step at a coiling temperature of 400° C. to lower than 550° C.;

a pickling step of pickling a hot-rolled sheet after the coiling step;

a cold rolling step of cold-rolling a hot-rolled sheet after the pickling step under conditions including a rolling reduction of 85% or more;

an annealing step of annealing a cold-rolled sheet obtained in the cold rolling step under conditions including an annealing temperature of 720° C. to 780° C.; and a temper rolling step of rolling an annealed sheet obtained in the annealing step under conditions including an elongation percentage of 0.5% to 5.0%.

6. A method for manufacturing the steel sheet for cans according to claim 2, comprising:

a heating step of heating a steel slab having the chemical composition at a heating temperature of 1,100° C. or higher;

a hot rolling step of hot-rolling a steel slab after the heating step under conditions including a finish hot rolling temperature of 830° C. to 940° C.;

a coiling step of coiling a hot-rolled sheet obtained in the hot rolling step at a coiling temperature of 400° C. to lower than 550° C.;

a pickling step of pickling a hot-rolled sheet after the coiling step;

a cold rolling step of cold-rolling a hot-rolled sheet after the pickling step under conditions including a rolling reduction of 85% or more;

an annealing step of annealing a cold-rolled sheet obtained in the cold rolling step under conditions including an annealing temperature of 720° C. to 780° C.; and a temper rolling step of rolling an annealed sheet obtained in the annealing step under conditions including an elongation percentage of 0.5% to 5.0%.

7. A method for manufacturing the steel sheet for cans according to claim 3, comprising:

a heating step of heating a steel slab having the chemical composition at a heating temperature of 1,100° C. or higher;

a hot rolling step of hot-rolling a steel slab after the heating step under conditions including a finish hot rolling temperature of 830° C. to 940° C.;

a coiling step of coiling a hot-rolled sheet obtained in the hot rolling step at a coiling temperature of 400° C. to lower than 550° C.;

a pickling step of pickling a hot-rolled sheet after the coiling step;

a cold rolling step of cold-rolling a hot-rolled sheet after the pickling step under conditions including a rolling reduction of 85% or more;

an annealing step of annealing a cold-rolled sheet obtained in the cold rolling step under conditions including an annealing temperature of 720° C. to 780° C.; and a temper rolling step of rolling an annealed sheet obtained in the annealing step under conditions including an elongation percentage of 0.5% to 5.0%.

8. A method for manufacturing the steel sheet for cans according to claim 4, comprising:

a heating step of heating a steel slab having the chemical composition at a heating temperature of 1,100° C. or higher;

a hot rolling step of hot-rolling a steel slab after the heating step under conditions including a finish hot rolling temperature of 830° C. to 940° C.;

a coiling step of coiling a hot-rolled sheet obtained in the hot rolling step at a coiling temperature of 400° C. to lower than 550° C.;

a pickling step of pickling a hot-rolled sheet after the coiling step;

a cold rolling step of cold-rolling a hot-rolled sheet after the pickling step under conditions including a rolling reduction of 85% or more;

an annealing step of annealing a cold-rolled sheet obtained in the cold rolling step under conditions including an annealing temperature of 720° C. to 780° C.; and a temper rolling step of rolling an annealed sheet obtained in the annealing step under conditions including an elongation percentage of 0.5% to 5.0%.

* * * * *